US006358157B1

(12) United States Patent
Sorenson

(10) Patent No.: US 6,358,157 B1
(45) Date of Patent: Mar. 19, 2002

(54) GOLF SWING STRENGTH TRAINER

(76) Inventor: James W. Sorenson, 2098 S. 260 St., Mt. Pleasant, IA (US) 52641

( * ) Notice: Subject to any disclaimer, the term of this patent is extended or adjusted under 35 U.S.C. 154(b) by 0 days.

(21) Appl. No.: 09/657,337

(22) Filed: Sep. 7, 2000

(51) Int. Cl.[7] ..... A63B 69/36

(52) U.S. Cl. ..... 473/219; 473/226; 473/256; 473/276; 473/297

(58) Field of Search ..... 473/219, 223, 473/226, 256, 292, 297, 316, 549, 300, 457, 553, 519, 524, 131, 282, 276; 482/97, 106, 107, 108, 109; 434/252

(56) References Cited

U.S. PATENT DOCUMENTS

| | | | | |
|---|---|---|---|---|
| 1,524,196 | A | * | 1/1925 | Matthews |
| 1,658,447 | A | * | 2/1928 | Lantz |
| 1,696,462 | A | * | 12/1928 | Victor |
| 2,091,458 | A | * | 8/1937 | Sleight |
| 2,396,408 | A | | 3/1946 | Benecke |
| 2,462,955 | A | | 3/1949 | Glancey |
| 2,532,646 | A | | 12/1950 | Severin |
| 3,231,281 | A | | 1/1966 | Wallo |
| 3,679,207 | A | * | 7/1972 | Florian |
| 3,743,297 | A | | 7/1973 | Dennis |
| 4,203,598 | A | * | 5/1980 | Stuff |
| 4,444,396 | A | | 4/1984 | Wendt |
| 4,600,195 | A | * | 7/1986 | Hunter |
| 4,953,868 | A | | 9/1990 | Thompson |
| 4,982,963 | A | | 1/1991 | Fazio et al. |
| 5,026,063 | A | | 6/1991 | Rhodes |
| 5,083,790 | A | | 1/1992 | Wheatley |
| 5,135,228 | A | | 8/1992 | Hawkins |
| 5,167,415 | A | * | 12/1992 | Iandola |
| 5,215,307 | A | * | 6/1993 | Huffman |
| 5,228,688 | A | * | 7/1993 | Davis |
| 5,249,803 | A | | 10/1993 | Giffin |
| 5,309,072 | A | * | 5/1994 | Pettinelli |
| 5,330,190 | A | | 7/1994 | Oakley, Jr. |
| 5,330,193 | A | | 7/1994 | Ijiri |
| 5,364,102 | A | * | 11/1994 | Appledorn |
| 5,405,138 | A | | 4/1995 | Duran |
| 5,460,378 | A | * | 10/1995 | Getts |
| 5,582,407 | A | | 12/1996 | Sorenson |
| 5,624,114 | A | * | 4/1997 | Kesley |
| 5,718,643 | A | * | 2/1998 | Wright |
| 5,776,006 | A | * | 7/1998 | Gruber |
| 6,213,890 | B1 | * | 4/2001 | Prince |

FOREIGN PATENT DOCUMENTS

| | | | | |
|---|---|---|---|---|
| GB | 2275201 | * | 8/1994 | ..... 273/81 A |

* cited by examiner

*Primary Examiner*—Sebastiano Passaniti
(74) *Attorney, Agent, or Firm*—Frank J. Catalano

(57) ABSTRACT

A golf swing strength trainer has a shaft of length not greater than that of a standard golf club shaft. A golf grip is fixed to one end of the shaft. A golf club head is fixed to the other end of the shaft. A pair of substantially equal weights is fixed concentrically on the shaft, one on each end of the grip, the center of gravity of the weights taken together being located substantially at a lengthwise center of the grip. Preferably, the weights abut the opposite ends of the grip. In use, as the axis of the shaft comes into horizontal and vertical alignment, the horizontal distance of the weights from the center of gravity is maximized and minimized. This relationship seems to trigger rather than inhibit the transitional phases of the swing. Since the weights, regardless of their anglular position, are equally displaced from the center of the grip, they tend to enhance rather than inhibit flow and transition of primary movers in the proper swing plane. At the same time, the muscles are responding to the total weight of the trainer, which serves to increase strength, the primary goal of the strength trainer.

8 Claims, 2 Drawing Sheets

GOLF SWING STRENGTH TRAINER

BACKGROUND OF THE INVENTION

This invention relates generally to athletic equipment and more particularly concerns golf swing strength training equipment.

In my earlier U.S. Pat. No. 5,582,407 issued Dec. 10, 1996, the mechanics of the golf swing were explained in great detail. The purpose of the swing trainer described in that patent was to enable a golfer, by use of a properly weighted training club, to break down incorrect muscle memory components of the swing and build up proper muscle memory components in their place so as to enable the golfer to maintain a correct swing plane of the golf club shaft. Over the years, the trainer has proven itself as a very effective tool for achieving this purpose and is presently used by over one hundred golf professionals and over 100,000 golfers at various stages in the development of their game.

In addition to developing proper swing plane, the release of maximum club head speed impacts the distance that can be achieved significantly. One of the primary factors related to club head speed is the strength of the muscles involved. While the swing trainer, because of its increased weight, has ancillary strength improvement characteristics, it is primarily directed to proper swing plane development. Since the center of gravity of the trainer is between the grip and the club head, dramatic increases in weight necessary to significantly increase strength becomes counterproductive to the purpose of the swing trainer.

As explained in my earlier patent, a proper golf swing breaks down into transitional phases marked by downward vertical, rearward horizontal, upward vertical and forward horizontal club orientation during the back swing, the down swing and the follow through. The portions of the swing between the downward vertical and forward or rearward horizontal positions predominantly involve rotation of the forearms. The portions of the swing between the forward or rearward horizontal positions and the upward vertical position predominantly involve shoulder turn. The portions of the swing between the upward vertical and forward or rearward horizontal positions predominantly involves the cocking or uncocking of the wrists. Significant increases in the weight of the club between the grip and the club head would negatively impact the flow or transition through the predominant body functions during the course of the swing.

It is, therefore, an object of this invention to provide a golf swing strength trainer which is weighted to increase strength of muscles used in a golf swing. Another object of this invention is to provide a golf swing strength trainer which is weighted to facilitate the transitional stages of a proper golf swing. A further object of this invention is to provide a golf swing strength trainer which is weighted to produce complementary moments about the center of the grip. Yet another object of this invention is to provide a golf swing strength trainer which is weighted by weights approximately equidistantly displaced from a center of the golf grip so as to focus the input of the weights at the center of the grips. It is also an object of this invention to provide a golf swing strength trainer which is weighted by one of substantially equal weights, one at each end of the grip, so as to minimize the impact of the weights on a proper swing plane.

SUMMARY OF THE INVENTION

In accordance with the invention, a golf swing strength trainer has a shaft of length not greater than that of a standard golf club shaft. A golf grip of substantially standard grip dimensions is fixed to and substantially concentric about an outer surface of one end of the shaft A golf club head is fixed to the other end of the shaft. A pair of substantially equal weights is fixed concentrically on the shaft, one on each side of the grip, the center of gravity of the weights taken together being located substantially at a lengthwise center of the grip. Preferably, the weights abut the opposite ends of the grip.

In one embodiment, the shaft is approximatley twice the length of the grip and the weights are each greater than one third of the total weight of the trainer. Most preferably, the weights are a minimum of three (3) pounds each and several trainers, each increasing the weights in one pound increments, are incorporated in a set.

As the axis of the shaft comes into horizontal and vertical alignment, the horizontal distance of the weights from the center of gravity is maximized and minimized. This relationship seems to trigger rather than inhibit the transitional phases of the swing. Since the weights, regardless of their anglular position, are equally displaced from the center of the grip, they tend to enhance rather than inhibit the flow of transition in the proper swing plane. At the same time, the muscles are responding to the total weight of the trainer which serves to increase strength, the primary goal of the strength trainer.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
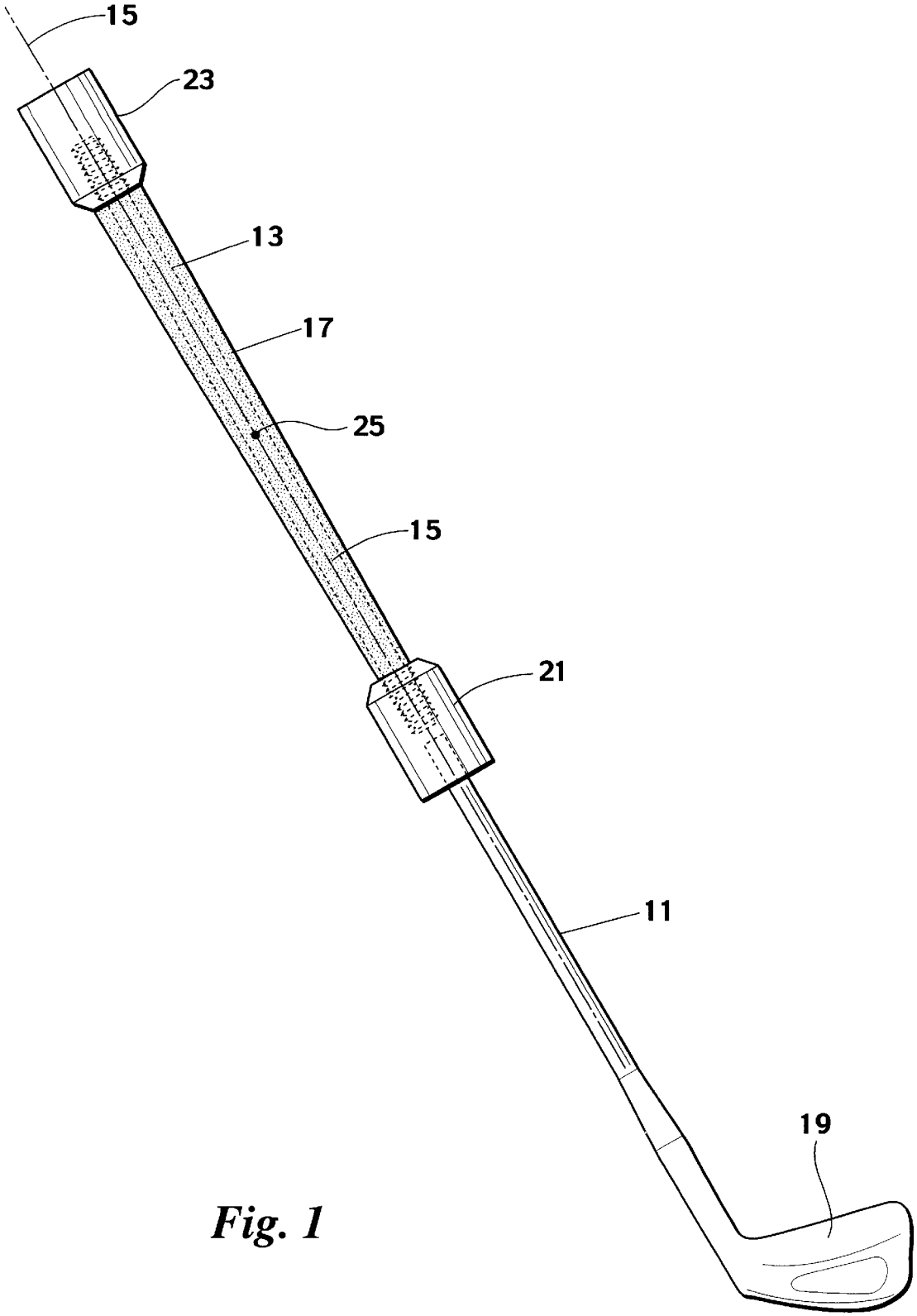
FIG. 1 is a side elevation view of a preferred embodiment of the golf swing strength trainer.

Looking at FIG. 1, the preferred embodiment of the golf swing strength trainer is illustrated. The trainer shown is configured for a right-handed player and is depicted as viewed from the right side of the player in an address position. The trainer consists of a shaft having overall length not greater than the length of the shaft of a standard golf club. As shown, the shaft is made in two sections, the lower shaft 11 and an upper shaft 13 concentrically aligned in end-to-end relationship on a longitudinal axis 15. Preferably, the lower shaft is a solid steel rod of ⅜" diameter and the upper shaft 13 is a solid steel rod of ½" diameter. The length of the upper shaft 13 is such that a golf grip 17 of substantially standard grip dimensions may be fixed to the outer surface of the upper end of the shaft in substantially concentric disposition about the shaft 13, tapering from larger to smaller diameter from the upper end to the lower end of the upper shaft 13. Alternatively, a training grip could be used. Training grips are similar in length to standard grips but are contoured to guide the golfer's fingers into a proper grip on the club. A golf club head 19 is fixed to the lower end of the lower shaft 11. Preferably, the length of the lower shaft 11 is such that the grip 17 covers approximately one-half the total length of the shaft including the lower 11 and upper 13 shafts taken together. The lower shaft 11 could, however, be considerably shorter. As shown, a pair of substantially equal weights are fixed to the ends of the upper shaft 13 on posts extending beyond the grip 17. As shown, the upper shaft posts are threaded to receive complementary threaded lower and upper weights 21 and 23. The weights 21 and 23 are substantially equal and, preferably, are configured to align concentrically on the shaft 13 and the longitudinal axis 15. Preferably, one weight abuts each side of the grip 17 and, as a result, the center of gravity 25 of the weights taken together is located substantially at the lengthwise center of the grip 17. The posts at the ends of the upper shaft 13 could be of extended length, however, provided the products of each of the weights 21 and 23 multiplied by their respective distance from the lengthwise center of the grip 17 are substantially equal. As shown, the lower shaft 11 is fixed to the lower weight 21 by sliding the upper end of the lower shaft 11 into a snug bore in the lower end of the lower weight 21 and adhering the lower shaft 11 and the lower weight 21 to each other with an epoxy resin. All of the connections of the shafts 11 and 13 with the weights 21 and 23 could be made by either threaded joints or by smooth posts with epoxy resin. Moreover, the shafts 11 and 13 could be made as a single shaft, perhaps of tapered diameter, with the weights 21 and 23 secured directly to the outer wall of the shaft. The critical requirement is that the moments of each of the weights 21 and 23 be equal in relation to the lengthwise center of the grip 15.

In the prototype trainers, a standard 12¼" length grip 17 was used between the lower 21 and upper 23 weights. The weights 21 and 23 were 2½" in length and approximately 1½" in diameter. The length of the lower shaft 11 from the bottom of the lower weight 21 to the top of the hozzle of the club head 19 was 7½". Several trainers were made using equal weights graduated in one pound increments beginning at three pounds. Any weight could be used, though it is preferred that each of the weights be at least one-third of the total weight of the trainer.

Figure 2:
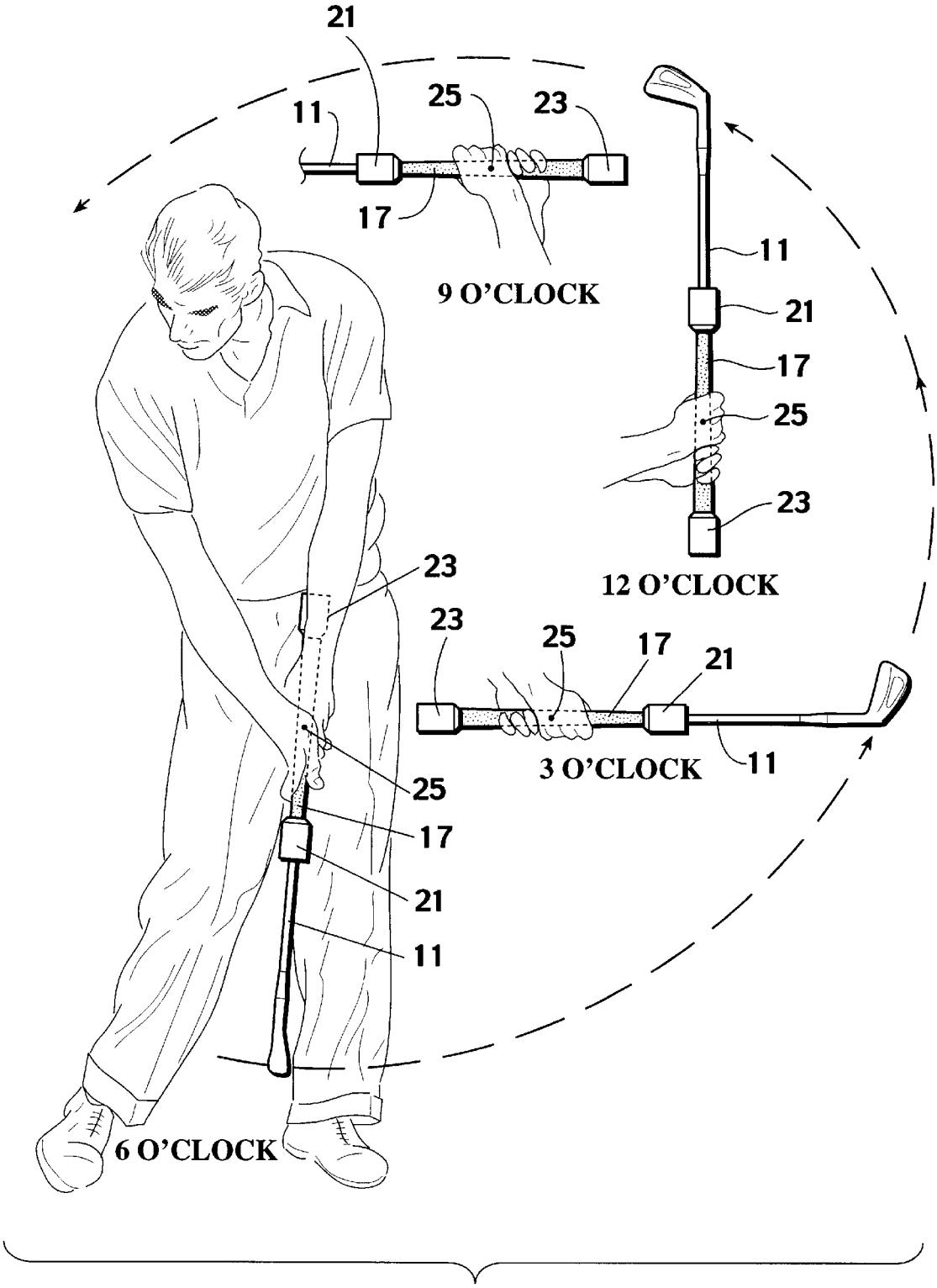
FIG. 2 is a sequential front elevation view of a golfer's grip on the strength trainer of FIG. 1 in the follow-through portion of the swing illustrating the principles of operation of the strength trainer.

The operation of the golf swing strength trainer is best understood by turning to FIG. 2 illustrating the transition points of the follow-through portion of the golf swing. The follow-through is the final third of the golf swing. All three thirds of the golf swing, including the back swing and down swing, are illustrated and explained in detail in my earlier U.S. Pat. No. 5,582,407. The club shaft rotates through a first 270 degree range of motion from downward vertical through rearward horizontal and upward vertical to a forward horizontal positon, through a second 270 degree range of motion from forward horizontal through upward vertical and rearward horizontal to downward vertical and, as shown in FIG. 2, through a third 270 degree range of motion from downward vertical through forward horizontal and upward vertical to rearward horizontal. At each transition point, a transfer of primary motion from forearms to shoulders to wrists, or vice-versa, occurs. In the vertical transition positions, the lower and upper weights 21 and 23 lie in a vertical plane while in the horizontal transition positions, the weights 21 and 23 are aligned in a horizontal plane. Thus, the affect of the weights on hand mechanics is minimized in the vertical condition and maximized in the horizontal condition. However, whether maximized or minimized, the transfer from increase to decrease or decrease to increase at the transition point operates as a trigger to coordinate the golfer's transfer to the appropriate primary motion, be it forearms, shoulders or wrists. As is readily observed in FIG. 2, since the center of gravity 25 of the combined weights 21 and 23 lies at a mechanical pivot point or center of the grip 17, the use of weights 21 and 23 providing an equal moment in relation to the center of gravity 25 balances the impact of the weights 21 and 23 on the golfer's mechanics at the focal point of the grip. Therefore, the added weight does not inhibit proper mechanics in the grip. Rather, at each transition point in the swing, the moments resulting from the weights 21 and 23 trigger the proper body mechanic responses and assist in the natural flow of the transitions through the swing. However, the weights 21 and 23 add significantly to the resistance experienced by the muscles used when swinging a golf club and therefore primarily and directly work to increase the strength of the golfer as applied in the execution of the swing. While the center of gravity mechanics are not inhibited because the weights are balanced, the lower portion of the strength trainer still affords the feel of a normal golf club to the weighted trainer.

As hereinbefore stated, the purpose of this strength trainer is to increase strength. It is designed to do so without inhibiting impact on the golfer's technique. It has the ancillary benefit of improving an appropriate or correct swing mechanic because of the trigger and flow benefits it provides. Conversely, the swing trainer of my earlier patent serves primarily to assist the golfer in the development of the proper mechanics and provides an ancillary benefit of strength training. It is believed that consistent use of both the swing trainer and weight trainer will maximize both the mechanics and strength of the golfer in the golf swing and therefore permit maximum club head speed to be efficiently directed in a proper plane to the point of impact with the golf ball.

Thus, it is apparent that there has been provided, in accordance with the invention, a golf swing strength trainer that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A golf swing strength trainer comprising:

a shaft having a length not greater than that of a standard golf club shaft;

golf grip fixed to an outer surface of one end of said shaft;

a golf club head fixed to another end of said shaft; and a pair of weights fixed concentrically on said shaft, one on each side of said grip, a center of gravity of said weights taken together being located substantially at a lengthwise center of said grip.

2. A golf swing strength trainer according to claim 1, said shaft being approximately twice a length of said grip.

3. A golf swing strength trainer according to claim 1, said weights each being greater than one third of a total weight of the trainer.

4. A golf swing strength trainer according to claim 1, said weights being substantially equal.

5. A golf swing strength trainer comprising:

a shaft;

a golf grip of substantially standard grip dimensions fixed to and substantially concentric about an outer surface of one end of the shaft;

a golf club head fixed to another end of the shaft at a distance such that said grip covers approximately half a length of said shaft; and a pair of substantially equal weights fixed concentrically on said shaft, one abutting each end of said grip.

6. A golf swing strength trainer according to claim 5, each said weight being greater than one third of a total weight of the trainer.

7. A golf swing strength trainer comprising:

a shaft;

a golf grip of substantially standard grip dimensions fixed to and substantially concentric about an outer surface of one end of said shaft;

a golf club head fixed to another end of said shaft at a distance such that said grip covers approximately half a length of said shaft; and a pair of substantially equal weights fixed concentrically on said shaft, one abutting each side of said grip, a center of gravity of said weights taken together being located substantialy at a lengthwise center of said grip.

8. A golf swing strength trainer according to claim 7, each said weight being greater than one third of a total weight of the trainer.

* * * * *